United States Patent [19]

Premi

[11] Patent Number: 4,630,433

[45] Date of Patent: Dec. 23, 1986

[54] METHOD FOR THE SPLICING OF TEXTILE THREADS BY MEANS OF A COMPRESSED GAS, AND SPLICING DEVICE FOR THE ACCOMPLISHMENT OF THE METHOD

[75] Inventor: Mauro Premi, Salo, Italy

[73] Assignee: Mesdan S.p.A., Salo, Italy

[21] Appl. No.: 796,436

[22] Filed: Nov. 8, 1985

[30] Foreign Application Priority Data

Nov. 12, 1984 [IT] Italy ..... 23530 A/84

[51] Int. Cl.[4] ..... D01H 15/00

[52] U.S. Cl. ..... 57/22; 57/263

[58] Field of Search ..... 57/22, 263

[56] References Cited

U.S. PATENT DOCUMENTS

| | | | |
|---|---|---|---|
| 3,379,002 | 4/1968 | Rosenstein | 57/22 X |
| 4,002,012 | 1/1977 | Norris et al. | 57/22 |
| 4,432,194 | 2/1984 | Luz | 57/22 |
| 4,452,035 | 6/1984 | Rohner et al. | 57/22 |
| 4,468,918 | 9/1984 | Rohner et al. | 57/22 |
| 4,565,059 | 1/1986 | Mima | 57/22 |

*Primary Examiner*—Donald Watkins

*Attorney, Agent, or Firm*—Cushman, Darby & Cushman

[57] ABSTRACT

To the purpose of obtaining the joining of textile threads, by means of a splice accomplished with compressed gas, by a short, strong joint of nearly imperceptible appearance, a method is proposed, which includes the following steps: inserting the two threads to be joined through a longitudinal slit in a splicing chamber provided in a head having two parallel opposite side walls perpendicular to the longitudinal axis of the chamber, in correspondence of which walls there are side outlets; substantially closing the side outlets of the chamber and at the same time locking the threads entering the chamber through its related side outlets, against the respective side walls of the head, but leaving free and unlocked the cut tails of the thread coming out of the outlets; and subjecting the thread lengths enclosed within the chamber to at least one burst of compressed gas blown into the chamber, the gas escaping through a port provided in the head transversely to the longitudinal axis of the chamber. The device includes a head provided with parallel side walls wherein a splicing chamber is provided with its longitudinal axis perpendicular to the side walls, and opening through the same walls, with a longitudinal slit for the introduction of the threads to be joined into the chamber, and with a transverse slit for the escape of air, as well as elements movable to approach and move away from the respective side walls of the head, to substantially close the outlets of the chamber, and to lock the threads entering the chamber against the respective side walls, but leaving free and unlocked the cut tails of the threads coming out of the chamber. The longitudinal slit may be closed by a cover.

10 Claims, 25 Drawing Figures

Figure 1:
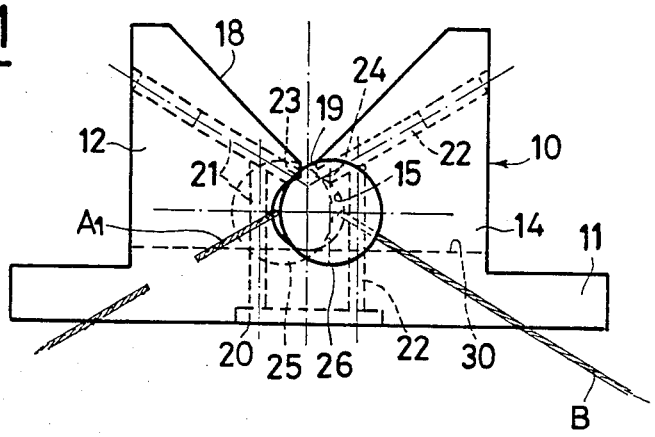

METHOD FOR THE SPLICING OF TEXTILE THREADS BY MEANS OF A COMPRESSED GAS, AND SPLICING DEVICE FOR THE ACCOMPLISHMENT OF THE METHOD

The present invention relates to a method for the splicing of textile threads by means of a compressed gas, and to a splicing device for the accomplishment of such a method.

Methods and devices are known for the splicing of textile threads by means of compressed gas, normally compressed air. The splicing process is carried out in a so-called splicing or mixing chamber, into which the threads to be joined are introduced so as to be submitted to the action of at least one burst of compressed air blown into the inside of the chamber through at least one nozzle leading into the same chamber. The splicing chamber may have cross sections of different shapes, and is provided in a so-called splicing head constituted by a body with parallel opposite side walls perpendicular to the longitudinal axis of the chamber. A longitudinal slit provided in the head serves for the introduction of the threads to be joined into the splicing head, which at its longitudinal ends has outlets leading to the outside in correspondence of the two side walls of the head. In some cases, such a longitudinal slit is closed by means of a cover after the threads to be joined with each other have been inserted inside the splicing chamber.

In all these splicing devices it is envisaged that the air may mainly escape to the outside through the side outlets of the same chamber in a substantially axial direction relatively to the position taken by the threads inside the chamber during the splicing operation. It has been possible to observe that this lateral escape of air from the splicing chamber causes some drawbacks due to the fact that the threads undergo, immediately outside the chamber, the effect of uncontrollable air vortexes. As the air is not any longer guided by the walls of the same chamber, such vortexes cause rubbing of the threads against the edges of the lateral outlets of the chamber, thereby causing weakening of the threads. The result of such drawbacks is a loss in tensile strength, and an imperfect aesthetical appearance of the joint.

Attempts to partially close the lateral outlets of the splicing chamber are already known (see e.g. U.S. Pat. Nos. 4,002,012; 4,419,859; 4,423,586; and 4,414,798 and the German Patent application No. 3,215,423), mainly to the purpose of limiting the extent of the "balloon" effect on the threads, and of increasing the efficiency of the air vortexes inside the splicing chamber. Also in these cases, the main escape of air from the splicing chamber occurs however through the lateral outlets of the same chamber.

The purpose of the present invention is to provide a method for the pneumatic splicing of textile threads, and a related splicing device, such as to eliminate the above mentioned drawbacks, and to obtain thread joints of better quality and of greater tensile strength than those which may be accomplished by the methods and the devices presently known, in particular very short, strong joints of nearly imperceptible appearance.

In order to achieve this purpose, the present invention starts from the principle of avoiding, during the splicing operation, as far as possible, the escape of the air through the lateral outlets and in the axial direction to the position of the threads inside the chamber, and of providing on the contrary at least one port for the escape of air transversely to the longitudinal axis of the chamber.

In this way, the joint is formed only inside the chamber whereby the joint is of constant and predetermined length corresponding to the length of the chamber. The threads are not subjected to whirling streams of compressed air outside the chamber, in order not to change the structure, strength and appearance of the threads at the sides of the joint.

The present invention provides hence a method for the splicing of textile threads by means of a compressed gas, which comprises the steps of inserting through a longitudinal slit the two threads to be joined inside a splicing chamber provided in a splicing head having two opposite parallel side walls perpendicular to the longitudinal axis of the chamber, in correspondence of which walls there are side outlet openings, and of subjecting the lengths of threads enclosed within the chamber to at least one burst of compressed gas blown into the inside of the chamber, said method being characterized in that before the introduction of the compressed gas into the splicing chamber, the two lateral outlets thereof are substantially closed, at the same time locking the threads entering the chamber through its respective side outlets, against the respective side walls of the head, and leaving free and unlocked the cut tails of the threads extending out of the outlets, and that the compressed gas blown into the chamber escapes mostly through a port provided in the head transversely to the longitudinal axis of the chamber.

The splicing device for the accomplishment of the method according to the invention comprises a head with parallel side walls, wherein a splicing chamber is provided, with its longitudinal axis being perpendicular to said walls, and having outlet openings in correspondence of the same walls, with a longitudinal slit for the introduction of the threads to be joined inside the chamber, as well as at least one nozzle leading into the interior of the chamber for the inlet of a compressed gas, said device being characterized in that in the head at least one escape port leads from the splicing chamber to the outside and which is positioned transversely to the longitudinal axis of the chamber, and that there are elements movable to approach and move away from the respective side walls of the head, to substantially close the outlets of the chamber, and to lock the threads entering the chamber against the respective side walls but leaving free and unlocked the cut tails of the threads extending out of the chamber.

Said elements for the closure of the outlets of the splicing chamber and for locking the threads entering the chamber may move linearly and perpendicularly relative to the side walls of the splicing head in synchronism with each other, or they may be oscillating in a plane perpendicular to said side walls, so as to be able to move on command alternatively to a position spaced apart from the lateral outlets of the chamber and to a position abutting against said side walls in correspondence of said outlets.

For the purpose of locking the thread entering the chamber and of leaving unlocked the cut tail of the second thread extending out of the chamber in correspondence of each side outlet of the chamber, each respective closure and locking element is provided with a front surface intended for abutting against the respective side wall of the head in correspondence of the respective outlet of the chamber, which front surface must be larger than the cross section of said outlet, having care however that in the position of the element abutting against the side wall of the head, a slit may remain free, allowing the cut tail to come out freely without being locked or pinched. This slit can be created, e.g., by slightly offsetting the closure and locking element relatively to the longitudinal axis of the chamber, or providing on the front surface of said element or on the side wall of the head a notch to allow the cut tail of the thread to move out freely, thereby avoiding the locking thereof.

For the purpose of the present invention neither the cross section of the splicing chamber, which may be of V-shape, circular, mixed or the like, nor the number and the position of the nozzles leading into the chamber for the inlet of compressed gas is important.

The longitudinal slit provided in the splicing head for the purpose of allowing the insertion of the threads to be joined into the chamber may remain open during the splicing operation, on condition that this slit has such a shape and size as to avoid the escape of the threads out of the chamber, but this slit may also be closed by a cover in a known way after the introduction into the chamber of the threads to be joined.

The opening(s) transverse to the longitudinal axis of the splicing chamber provided for the escape of the compressed gas blown into the chamber through the nozzles may be accomplished in different ways. To that purpose there can be provided e.g. at least one slit provided in the splicing head transverse to the longitudinal axis of the chamber, but instead of such a transverse slit, also transverse bores could be provided in the splicing head, freely leading from the chamber to the outside. The size or cross section area of these escape slits or bores must be of course proportioned to the amount of compressed gas introduced into the splicing chamber.

The splicing method and device according to the invention is disclosed hereunder in greater detail, with reference to the attached drawings, which illustrate some exemplifying embodiments.

Figure 2:
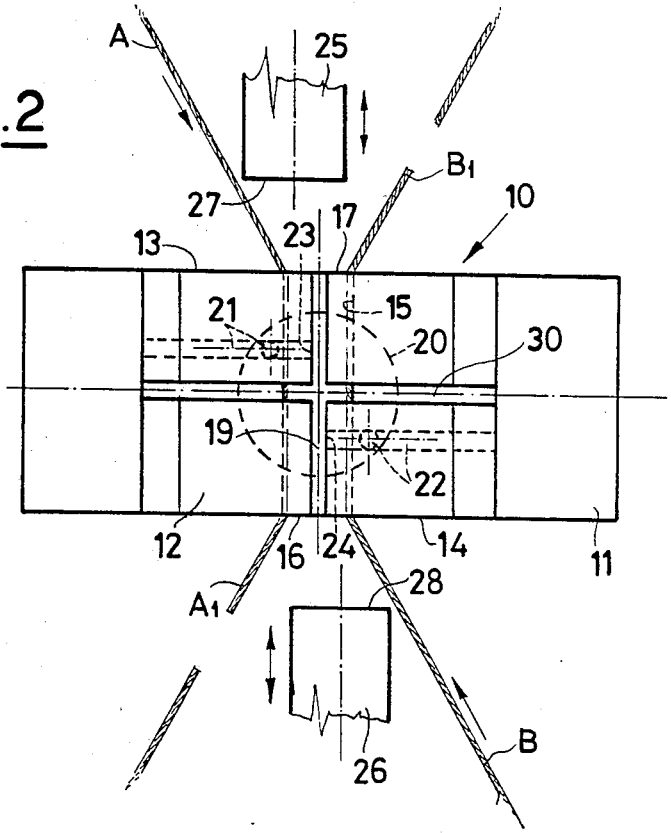
Figure 3:
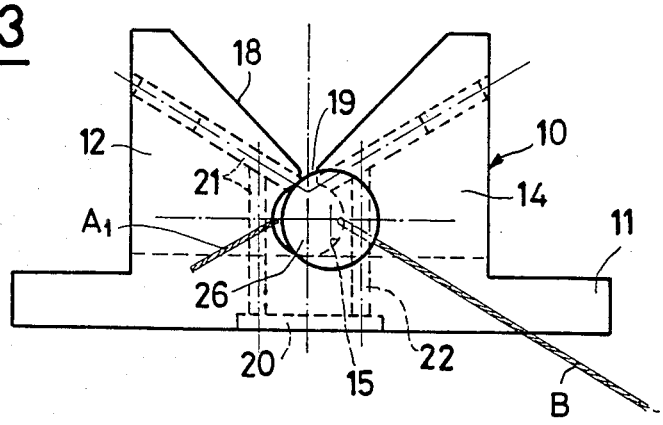
Figure 4:
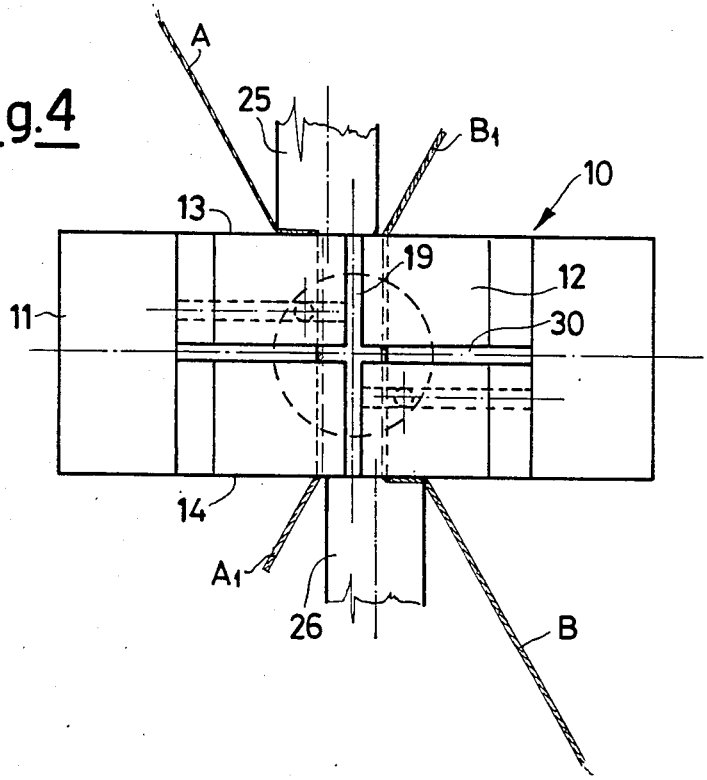
Figure 5:
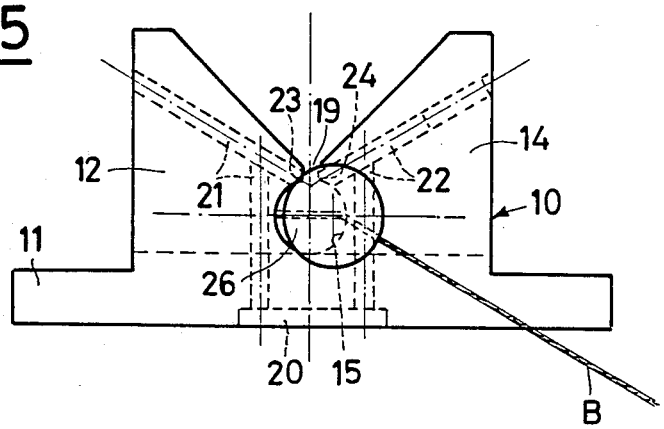
Figure 6:
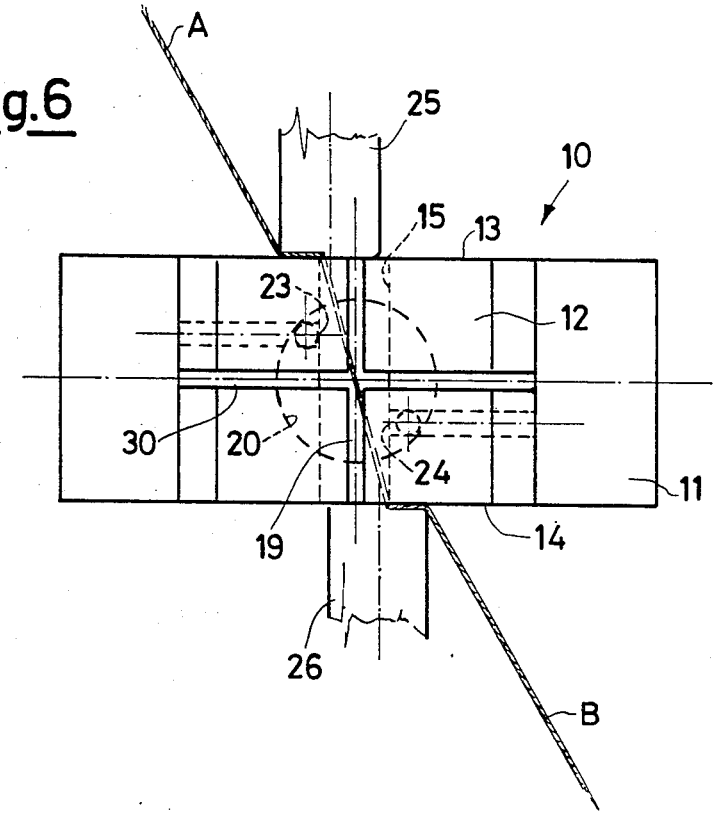
Figure 7:
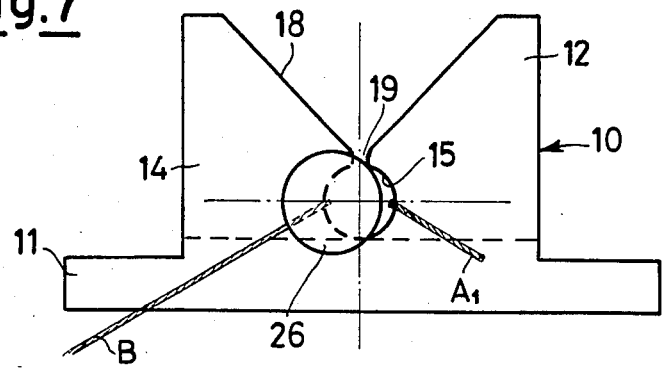
Figure 8:
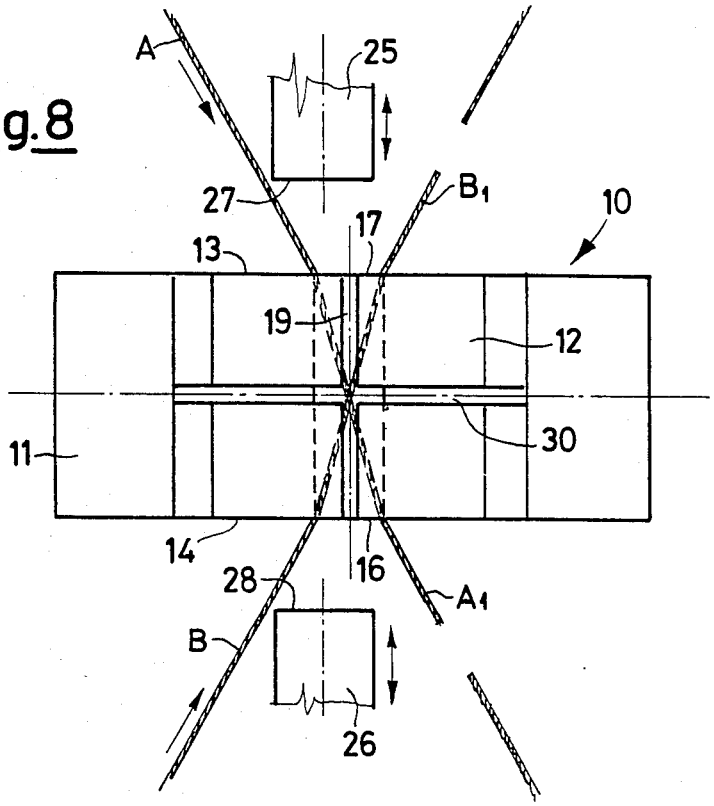
Figure 9:
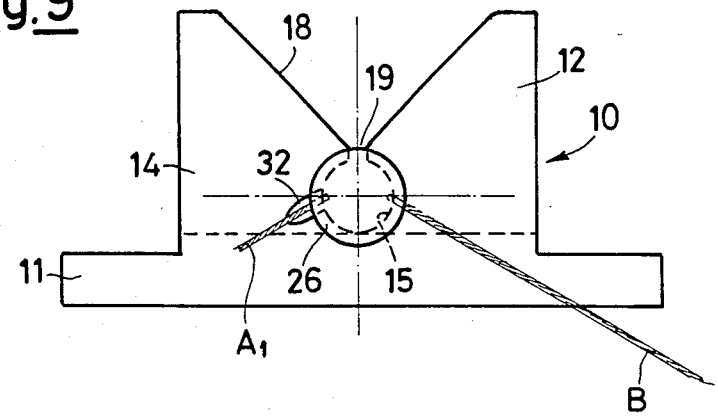
Figure 10:
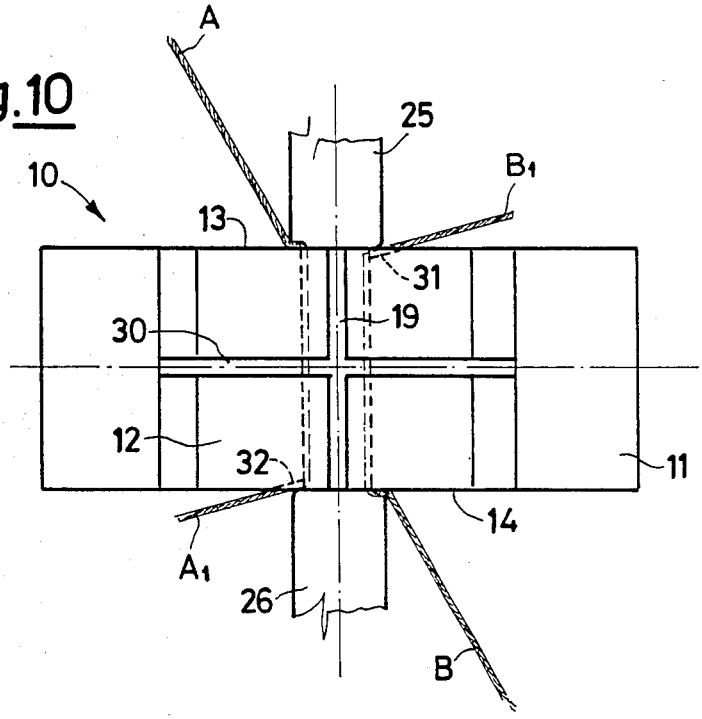
Figure 11:
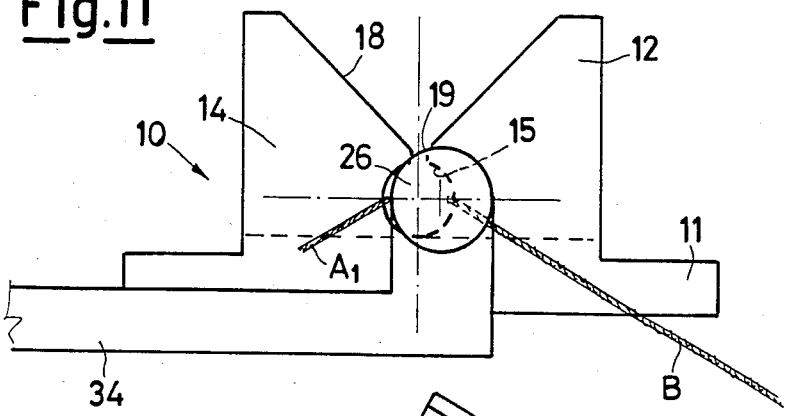
Figure 12:
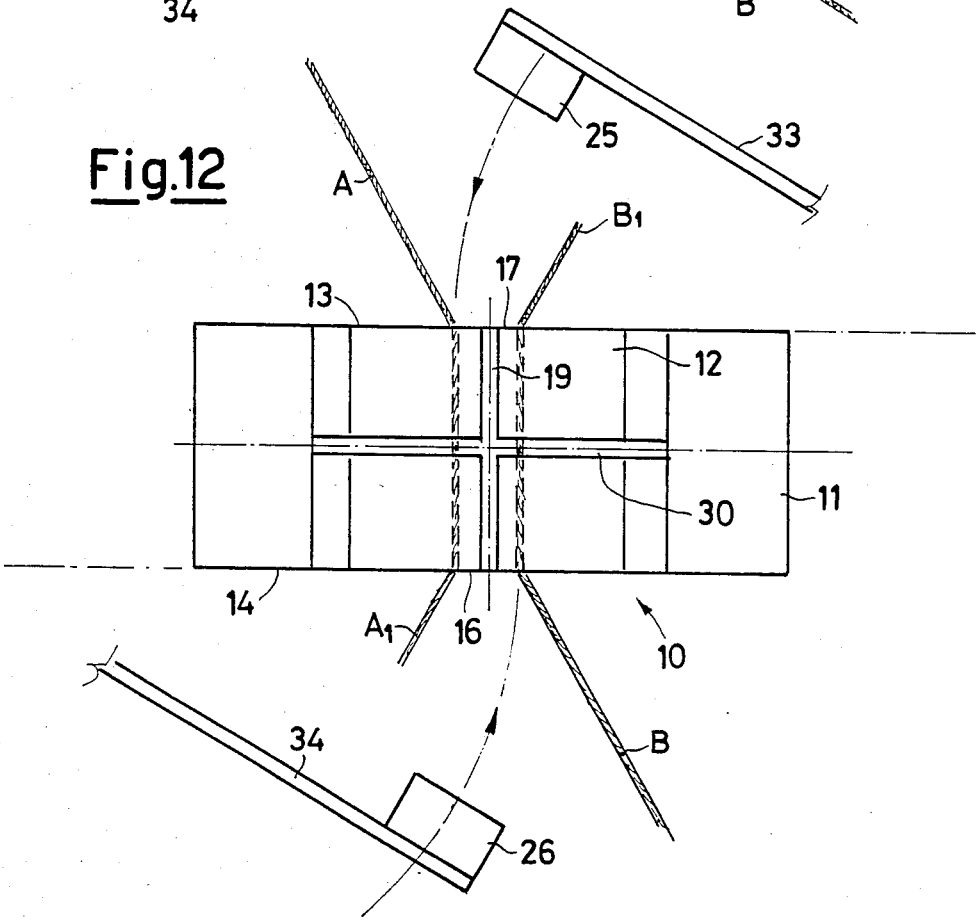
Figure 13:
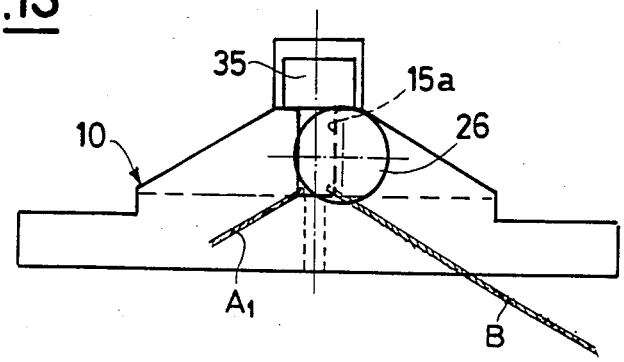
Figure 14:
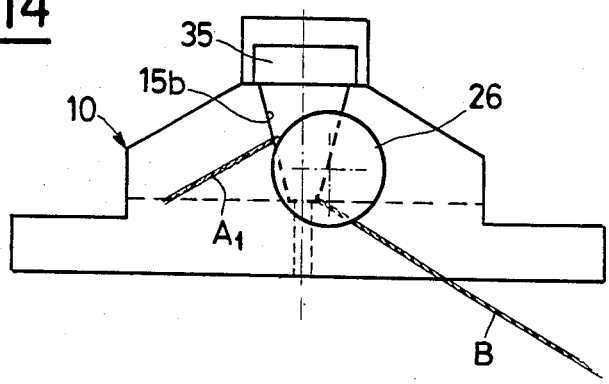
Figure 15:
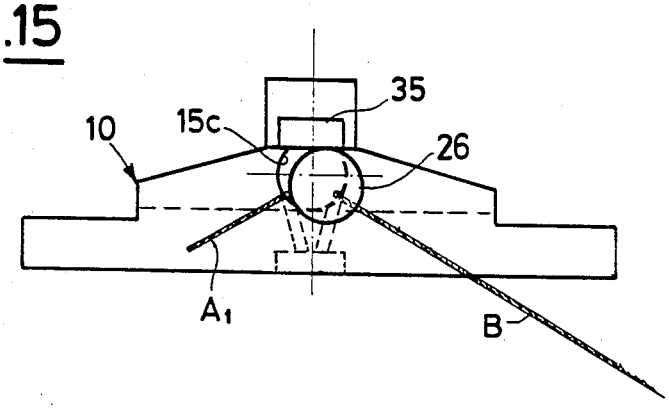
Figure 17:
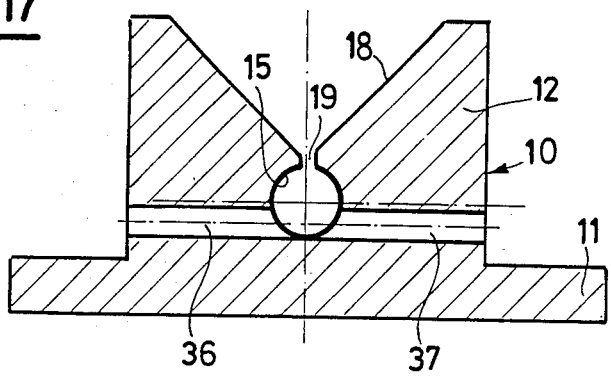
Figure 16:
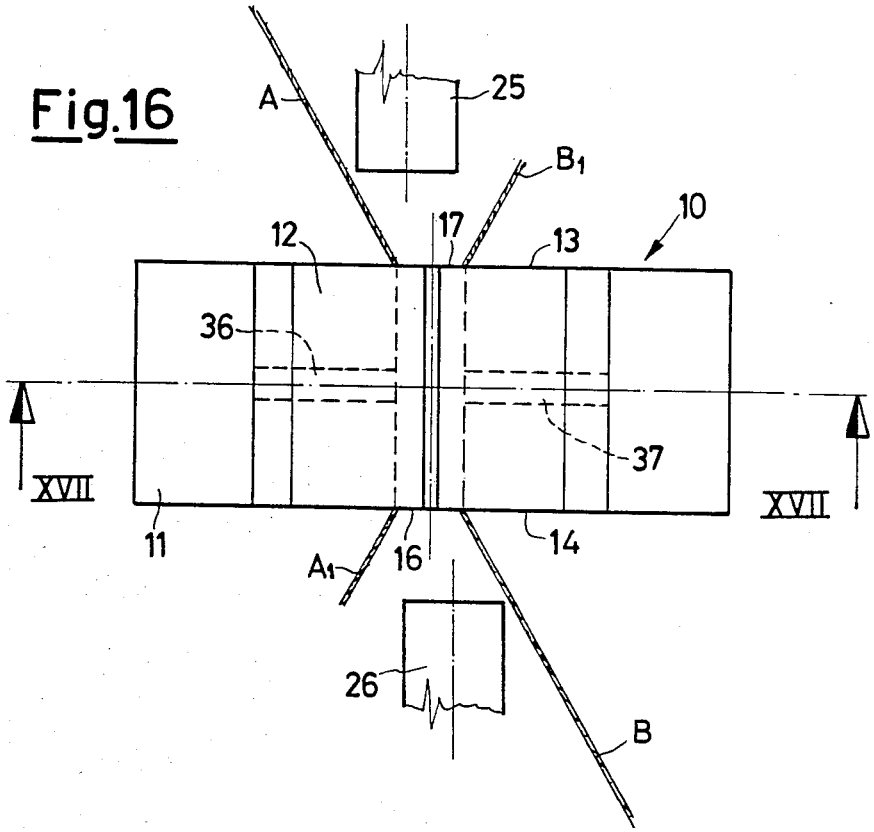
Figure 18:
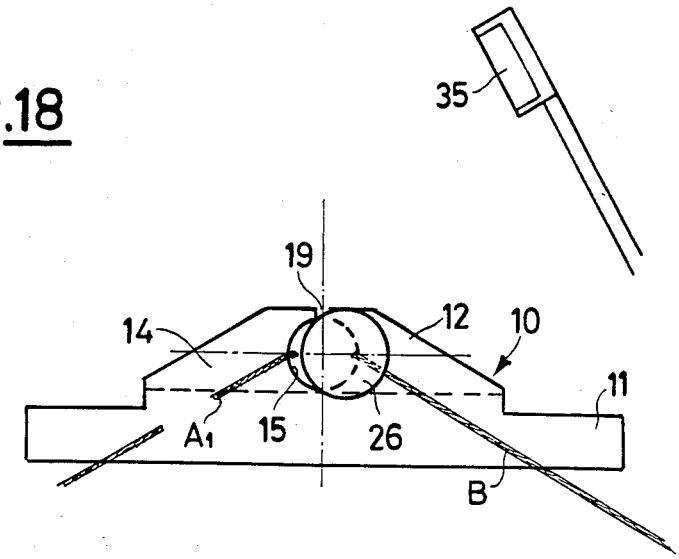
Figure 19:
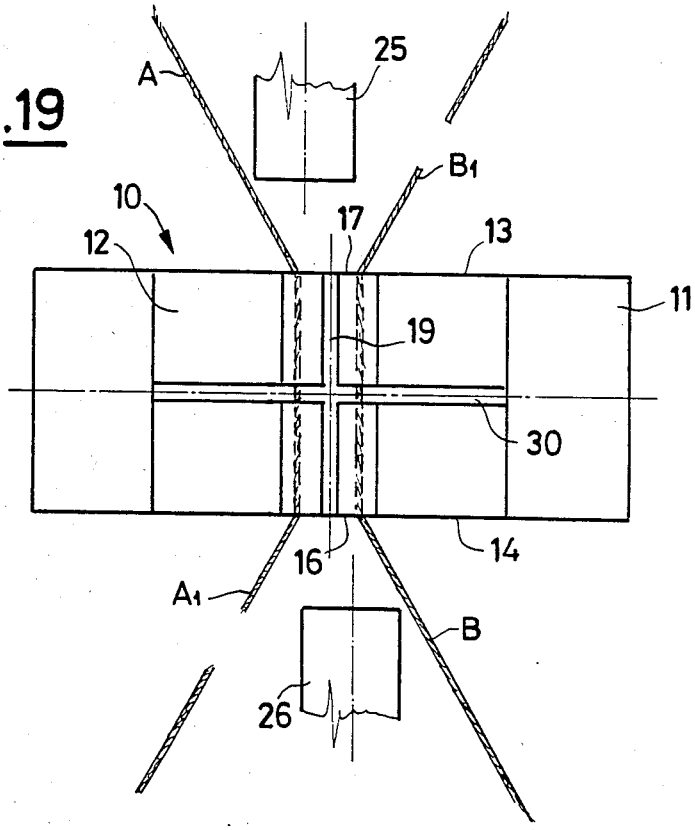
Figure 20:
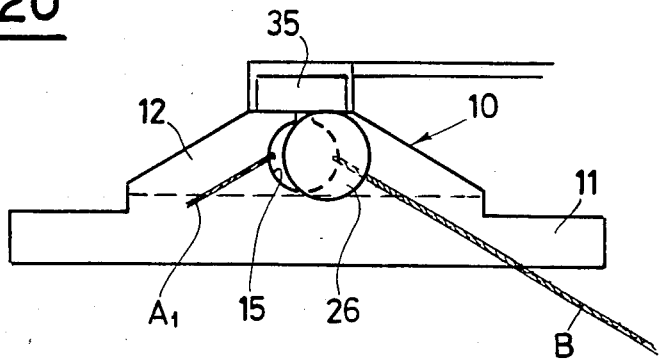
Figure 21:
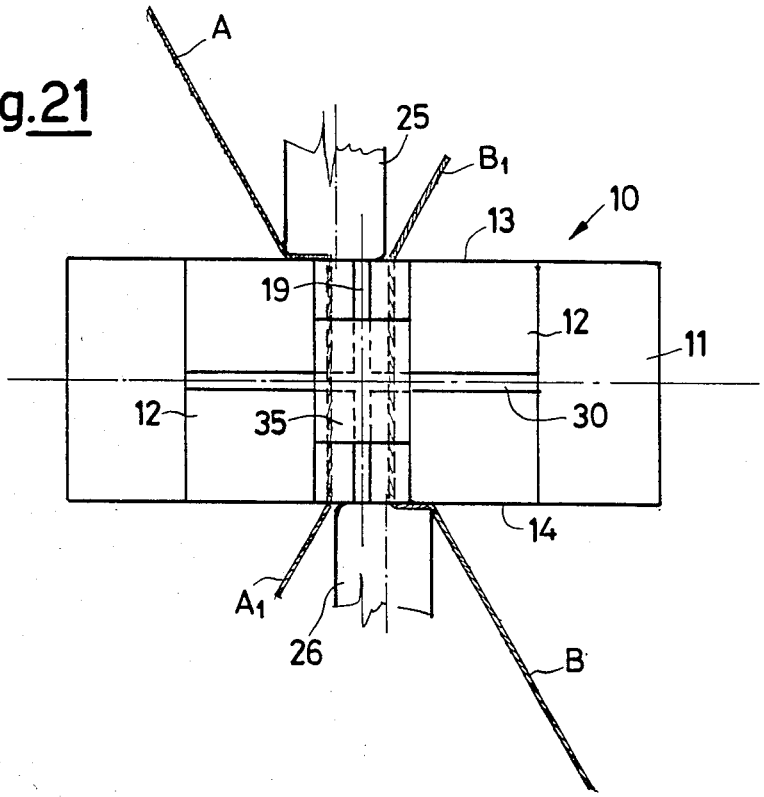
Figure 22:
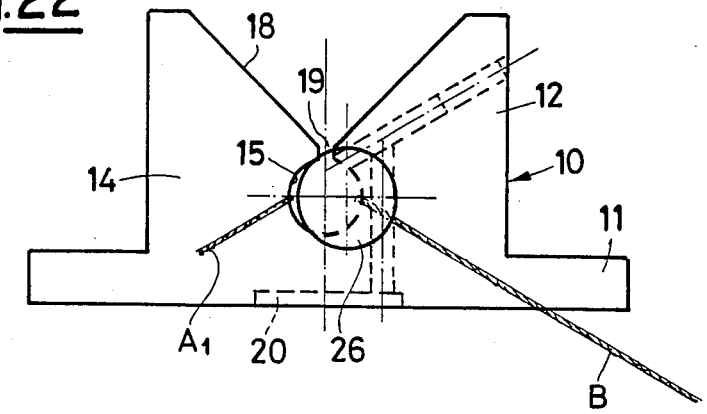
Figure 23:
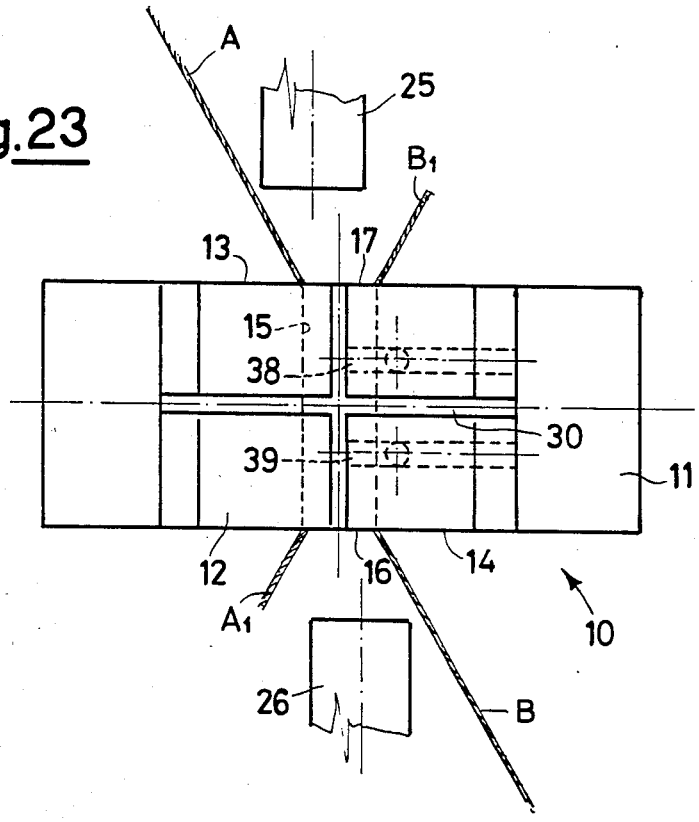
Figure 24:
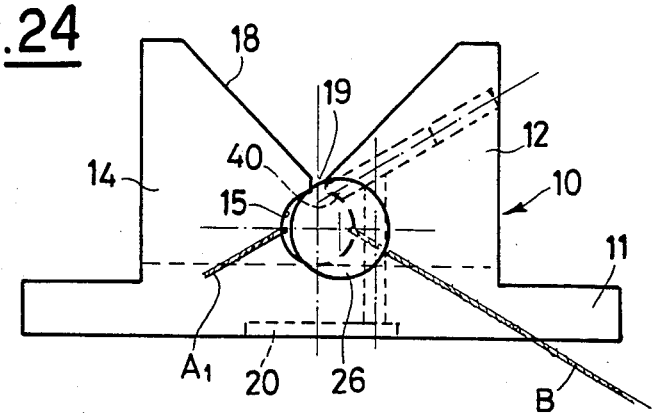
Figure 25:
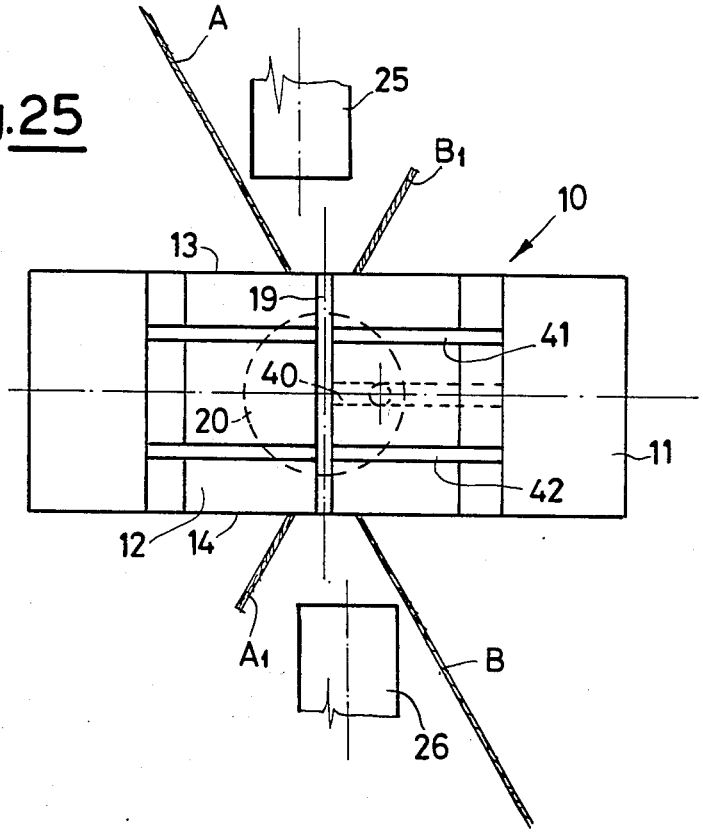

In particular:

FIGS. 1 and 2 show a side and top view of a splicing device according to the invention in a first operative step, FIGS. 3 and 4 are analogous views as of FIGS. 1 and 2, showing the device in a second operative step, FIGS. 5 and 6 show the same device as of preceding figures in a third operating step, FIGS. 7 and 8 show a splicing device similar to that of previous figures used for a different way of introducing the threads to be joined into the chamber, FIGS. 9 and 10 show a side and top view of a different embodiment of the splicing device, FIGS. 11 and 12 show a further embodiment of the splicing device, FIGS. 13, 14 and 15 are side views of splicing devices wherein the splicing chamber has different sections, and can be closed by a cover, FIG. 16 is a top view of a still further embodiment of the splicing device, FIG. 17 is a transversal cross section of the device according to FIG. 16, made along the path XVII—XVII, FIGS. 18–19 and 20–21 show in two successive operating steps an embodiment of the splicing device analogous to that of FIGS. from 1 to 6, but wherein the chamber can be closed by a cover, FIGS. 22–23 show a device analogous to that of FIGS. 1 and 2, but with a different position of the nozzles for the introduction of compressed air into the chamber, and FIGS. 24 and 25 show a further different embodiment of the splicing device.

It should be understood that the splicing head is mounted on an automatic or semiautomatic equipment of known type and hence not shown, which equipment is provided with all the auxiliary means and devices necessary for carrying out the splicing operation, including means for the control of the movements of the closure elements of the side outlets of the splicing chamber. These latter means can be operated by the central control system for the equipment, e.g. through suitable cams.

Referring first to FIGS. from 1 to 6, there is shown a splicing head generally indicated with 10, which head comprises a base 11 for the fastening thereof on to the equipment (not shown) and a body 12. The head 10 has two side walls 13 and 14 opposite and parallel to each other. Inside the body 12 of the head 10 a chamber 15 is provided, which, in the case shown in FIGS. from 1 to 6, has a circular transversal cross section, and an axis perpendicular to the side walls 13 and 14. The chamber 15 has two lateral outlet openings in correspondence of the said walls 13 and 14, and these outlets are indicated in FIG. 2 with 16 and respectively 17.

The top of the body 12 has a V-shaped groove 18, and the bottom of such groove forms a longitudinal slit 19 parallel to the longitudinal axis of the chamber 15, through which slit the chamber communicates with the outside, to allow the two threads to be joined to be inserted into the chamber.

In the head 10 suitable ducts or holes are additionally provided, for feeding compressed air to nozzles leading into the chamber 15. In particular, inside the base 11 of the head 10 a circular manifold 20 is provided, to which compressed air is fed, in a known way, through suitable valve means (not shown), and from which ducts 21 and 22 lead to two opposite nozzles 23, 24 leading into the chamber 15 near the longitudinal slit 19. The nozzles 23, 24 are equidistant from the opposite sides of a transversal mid plane of the chamber 15.

The splicing device comprises moreover two elements suitable for cooperating with the opposite side walls 13 and 14 of the head 10 and constituted by two small pistons 25 and 26 (only partially shown) which can move axially on command (in the direction of the arrows as shown in FIG. 2), from a position spaced apart from the respective walls 13 and 14 (as shown in FIG. 2) to a position abutting against said walls (as shown in FIGS. 4 and 6). These pistons have a twofold function: first of all, they must close as far as possible the side outlets 16 and 17 of the chamber 15 after insertion of the threads, and secondly they must lock the threads against the respective side walls 13 and 14 at the inlet side of the chamber, but leave the threads unlocked at the outlet side of the chamber.

In FIGS. from 1 to 6 the two threads to be joined, respectively indicated with A and B, are introduced into the chamber from opposite sides, that is to say, the thread A enters through the side outlet 17, and the thread B enters through the outlet 16 into the chamber 15, and said threads are positioned parallel to each other inside the chamber. The free cut tail $A_1$ of the thread A hence comes out of the chamber 15 through the side outlet 16, and the free cut tail $B_1$ of the thread B comes out of the chamber through the side outlet 17.

In order to lock the thread A against the side wall 13 of the head 10, leaving the cut tail $B_1$ of thread B free and unlocked, as well as to lock the thread B against the side wall 14 of the head 10 while leaving the cut tail $A_1$ of the thread A free and unlocked and to be able at the same time to close as far as possible the side openings 16 and 17 of the chamber 15, each of the elements 25 and 26 has a front surface 27 and respectively 28, which is larger than the cross section of the side outlets 16 and 17 of the chamber. The elements 25 and 26 are positioned with their axes parallel to the longitudinal axis of the chamber 15, in a plane parallel to the base 11 of the head 10 and containing said longitudinal axis of the chamber. One element is offset to one side, and the other element is offset to the opposite side relative to the longitudinal axis of the chamber. In particular, the piston element 25 is shifted towards the inlet position of the thread A to the chamber and the piston element 26 is shifted towards the inlet position of the thread B to the chamber, as is seen in the drawing. It follows therefrom that in its position abutted against the respective side walls 13 and 14 of the head 10, the element 25 locks the thread A and leaves free a small slit in the outlet 17 of the chamber, through which the cut tail $B_1$ of the thread B comes out without being locked, whilst the element 26 locks the thread B and leaves free a small slit of the outlet 16, through which the cut tail $A_1$ of the thread A comes out, without being locked (see FIG. 4 in particular).

For the purpose of allowing the escape of the compressed air from the chamber 15 blown into the chamber through the nozzles 23, 24 during the splicing operation, keeping in mind that during such an operation the side outlets 16 and 17 of the chamber are substantially closed, openings transverse to the longitudinal axis of the chamber 15 are provided. In the case of the embodiment illustrated in FIGS. from 1 to 6, inside the body 12 of the head 10 a transversal slit 30 is provided in a transversal mid plane of the chamber 15. This slit 30, which is perpendicular to the slit 19 for the introduction of the threads into the chamber, reaches the bottom of the chamber and divides the body 12 into two parts, so that it places the splicing chamber in free communication with the outside, allowing the escape of the compressed air blown through the nozzle 23, 24. It is suitable that the transversal slit 30 be equidistant from the nozzles 23, 24 to allow the escape of the compressed air blown through each one of the two nozzles to the same extent. The size of the escape slit 30 must be proportioned to the amount of air introduced into the chamber 15, so as to allow the escape through it of the most of the air. It is clear that a minor portion of the air can leave the chamber 15 also through the slit 19, and through the small slits left open by the elements 25 and 26 in correspondence of the side outlets 16 and 17. The slit 19 must have such dimensions as to prevent an escape of the threads during the splicing operation. The slits remaining open in correspondence of the side outlets of the chamber must be as small as possible so as to avoid interaction of the threads with whirling streams of compressed air outside the chamber.

FIGS. 1 and 2 show the situation wherein the threads A and B to be joined have already been introduced into the chamber 15 with the side outlets 16 and 17 being open, the piston elements 25 and 26 being spaced apart. In the subsequent step as shown in FIGS. 3 and 4, the piston elements 25 and 26 are abutting against the side walls 13 and 14 of the head, substantially closing the side outlets 16 and 17 of the chamber 15, and locking against the respective walls 13 and 14, whilst the cut tails $A_1$ and $B_1$ coming out of the chamber remain unlocked.

FIGS. 5 and 6 show at last the situation during the splicing operation, with the joint between the threads A and B having already been formed. It should be noted that the side outlets 16 and 17 of the chamber 15 are substantially closed by the elements 25 and 26, so that the joint is limited to the length of the threads inside the chamber and is of a constant and pre-arranged length. The threads at the sides of the joining zone, by being out of the chamber 15 and out of the locking points against the side walls 13 and 14 of the head 10 do not undergo the action of whirling streams of compressed air, and hence their structure is not varied and their characteristic of strength and of appearance remain unchanged.

Hereunder some different embodiments of the splicing device shall now be disclosed. In the following disclosure, the components of the device already described, and corresponding to components of the device illustrated in FIGS. from 1 to 6 are indicated with the same reference numbers.

The device illustrated in FIGS. 7 and 8, wherein the related nozzles for the blowing of compressed air into the chamber 15 and their respective supply ducts are not shown, differs from that disclosed up to now, in that the threads A and B be joined are in a crossing position inside the chamber. The piston elements 25 and 26 are hence lined up, and the locking of the threads A and B entering the chamber 15 through the outlets 17 and respectively 16, takes place at both chamber ends on the same axis parallel to the longitudinal axis of the chamber, and shifted relative to this axis towards the inlet point of the threads into the chamber.

Also the device as shown in FIGS. 9 and 10 corresponds substantially to that according to FIGS. from 1 to 6, with the only difference that the piston elements 25 and 26 are positioned coaxially relatively to the longitudinal axis of the chamber 15, so that in their position abutting against the side walls 13 and 14 of the head 10, they completely close the side outlets of the chamber. For the purpose of avoiding in this case the locking of the cut tails $A_1$ and $B_1$ coming out of the chamber, the side walls 13 and 14 of the head are provided with suitable notches 31 and respectively 32, starting from the edges of the respective side outlets of the chamber, and through which said cut tails $A_1$ and $B_1$ may freely escape, without being locked or pinched by the piston elements 25 and 26 abutting against the side walls 13 and 14 of the head 10.

The embodiment of the device as shown in FIGS. 11 and 12 is different from the preceding ones simply in that the piston elements 25 and 26 for closing the side outlets 17 and 16 of the chamber 15 and for locking the threads A, B entering the chamber, instead of being so arranged as to carry out an axial rectilinear movement, are borne by respective arms 33 and 34. These arms perform rotation movements, in a plane parallel to the base 11 of the head 10, towards and from the respective side walls 13 and 14 of the head 10.

FIGS. 13, 14 and 15 show different embodiments of splicing heads with splicing chambers having different transversal cross sections, and arranged to be closed, for the splicing operation, by means of a cover 35.

The head 10 of FIG. 13 has a splicing chamber **15*a* of rectangular cross section, that of FIG. 14 shows a chamber 15*b*** of V-shaped cross section, and that of FIG. 15 has a chamber 15c of about semicircular cross section. It is clear that with splicing chambers of this kind, having a relatively large longitudinal slit, a cover 35 must be provided, in a known way, for the purpose of closing such a slit during the splicing operation, to prevent the escape of the threads.

In FIGS. 16 and 17 an embodiment of the splicing device is shown, which differs from the embodiments of FIGS. from 1 to 6 in that instead of a transversal slit for the escape of the compressed air blown into the chamber 15, transversal bores 36 and 37 are provided, which, starting from the bottom of the chamber 15 extend throughout the body 12 of the head 10, freely leading to the outside.

In FIGS. 18–19 and 20–21 a further embodiment of the device as of FIGS. from 1 to 6 is shown in two different operating steps, to show that also in the case of a cylindrical splicing chamber 15 with a relatively narrow longitudinal slit 19 for the introduction of the threads A and, it is possible to use a cover 35 which, after the introduction of the threads into the chamber has been effected, closes the slit 19 at least partially (see FIGS. 20 and 21), to avoid the escape of air through the slit to a greater extent. In this case clearly, as well as in the case of the heads as shown in FIGS. 13, 14 and 15, the head have a planar upper end for the abutting of the cover.

FIGS. 22–23 and 24–25 show at last splicing devices similar to that as of FIGS. from 1 to 6, but with a different arrangement of the nozzles leading into the splicing chamber for the supply of compressed air.

In the embodiment shown in FIGS. 22–23, two nozzles 38 and 39 with respective compressed-air supply ducts are provided, which nozzles lead to one side only of the chamber 15, in positions equidistant from the transversal slit 30 for the escape of compressed air.

In the embodiment shown in FIGS. 24 and 25 a single central nozzle 40 is on the contrary provided, and in this case for the escape of compressed air from the chamber 15 two parallel transversal slits 41 and 42 equidistant from the central nozzle 40 are provided.

Some non-limiting examples of embodiments of the splicing device according to the invention have been shown, and it should be understood that such examples may also be variously combined with each other, it remaining the basic principle of the invention to close as far as possible the side outlets of the splicing chamber, by means of mobile elements, and to lock the threads at both sides of the chamber, leaving unlocked on the contrary the thread ends or cut tails coming out of the chamber. In this way, the threads entering the chamber, in correspondence of the side outlets of the same, are clearly separated from the outcoming ends or cut tails, and not placed side by side to them, and during the splicing operation a thread joining zone of constant and pre-established length is obtained, and the threads, at the sides of the joint zone, do not undergo changes in structure and in their strength and appearance characteristics.

I claim:

1. A method for the splicing of two textile threads by means of a compressed gas which comprises the steps of inserting the two threads to be joined through a longitudinal slit into a splicing chamber having a longitudinal axis and provided in a head having two opposite parallel side walls perpendicular to the longitudinal axis of the chamber, in correspondence of which walls there are side outlet openings of the same chamber, and subjecting the lengths of threads enclosed within the chamber to at least one burst of compressed gas blown into the inside of the chamber, characterized in that before the introduction of the compressed gas into the splicing chamber, the side outlet openings are substantially closed, in that at the same time the threads entering the chamber are locked against the respective side walls of the head, and in that the cut tails of the threads extending out of the side outlet openings are left free and unlocked, and in that the compressed gas blown into the chamber escapes from the same mostly through at least one port provided in the head transversely to the longitudinal axis of the chamber.

2. A splicing device for the accomplishment of the method according to claim 1, comprising a head with parallel side walls, wherein a splicing chamber with a longitudinal axis is provided, with said longitudinal axis being perpendicular to said side walls, and having outlet openings in correspondence of said side walls, a longitudinal slit for the introduction of the threads to be joined inside the chamber, and at least one nozzle leading into the interior of the chamber for the inlet of compressed gas, characterized in that there is provided in the head at least one escape port starting from the splicing chamber and freely leading to the outside, said port being positioned transversely to the longitudinal axis of the chamber, and in that there are provided closure and locking elements which are movable to abut and move away from the respective side walls of the head, to substantially close the outlet openings and to lock the threads entering the chamber against the respective side walls while leaving the cut tails of the threads extending out of the chamber free and unlocked.

3. A device according to claim 2, characterized in that said closure and locking elements are movable linearly and perpendicularly relatively to the side walls of the head.

4. A device according to claim 2, characterized in that said closure and locking elements are mounted for oscillation in a plane perpendicular to said side walls of the head.

5. A device according to claim 2, characterized in that in their position abutting against the side walls of the head said closure and locking elements are shifted laterally to the longitudinal mid plane of the chamber, leaving free a slit of the respective side outlet opening of the chamber, for the respective thread cut tail to come out unlocked.

6. A device according to claim 2, characterized in that in their position abutting against the side walls of the head, said closure and locking elements are centered relatively to the respective side outlet openings of the chamber, and have a front surface larger than the transversal cross section of said outlet openings, and that in correspondence of each one of said outlet openings a notch is provided for the respective thread cut tail to come out freely and unlocked.

7. A device according to claim 6, characterized in that said notch is provided on the front surface of each closure and locking element.

8. A device according to claim 6, characterized in that said notch is provided on each side wall of the head, starting from the respective side outlet of the chamber.

9. A device according to claim 2, characterized in that said escape port is formed by at least one slit provided in the head transversely to the longitudinal axis of the chamber.

10. A device according to claim 2, characterized in that said escape port is formed by at least one transversal bore provided in the head, which bore places the head in communication with the outside.

* * * * *